US005775747A

United States Patent [19]

Navarsky

[11] Patent Number: 5,775,747

[45] Date of Patent: Jul. 7, 1998

[54] LOCKING DEVICE FOR CONTAINER DOOR

[76] Inventor: Victor Navarsky, 10-9 Yamamoto-dori 3-chome, Chuo-ku, Kobe-shi, Hyogo, Japan, 650

[21] Appl. No.: 884,326

[22] Filed: Jun. 27, 1997

Related U.S. Application Data

[63] Continuation of Ser. No. 630,504, Apr. 10, 1996, abandoned.

[30] Foreign Application Priority Data

Nov. 29, 1995 [JP] Japan ..... 7-310327

[51] Int. Cl.[6] ..... B65D 55/00

[52] U.S. Cl. ..... 292/307 B; 292/307 R; 292/328; 292/DIG. 32; 70/211

[58] Field of Search ..... 292/307 R, DIG. 32, 292/104, 307 B, 205, 317, 327, 328, 329; 70/210, 211, 212, 201, 202, 203

[56] References Cited

U.S. PATENT DOCUMENTS

| | | | |
|---|---|---|---|
| 1,316,450 | 9/1919 | Karasch | 70/203 |
| 1,453,004 | 4/1923 | Collion | 70/203 |
| 2,742,726 | 4/1956 | Feller | 70/202 |
| 4,317,346 | 3/1982 | Gutman | 70/212 |
| 4,331,012 | 5/1982 | Swisher | 292/327 |
| 4,377,178 | 3/1983 | Thompson | 70/211 |
| 4,415,190 | 11/1983 | Finck, Jr. et al. | 292/327 |
| 4,426,861 | 1/1984 | Chillis | 70/203 |
| 4,493,198 | 1/1985 | Brown | 70/203 |
| 4,598,562 | 7/1986 | Freeman | 70/417 |
| 4,640,109 | 2/1987 | Schaublin et al. | 70/211 |
| 4,895,007 | 1/1990 | Eberly | 292/DIG. 32 |
| 4,898,008 | 2/1990 | Eberly | 292/32 |
| 5,046,770 | 9/1991 | Hansen | 292/218 |
| 5,064,326 | 11/1991 | Davis et al. | 292/327 |
| 5,145,222 | 9/1992 | Meyer | 70/202 |
| 5,363,677 | 11/1994 | Cox | 70/417 |
| 5,388,435 | 2/1995 | Bailey | 70/211 |
| 5,511,399 | 4/1996 | Lynn | 70/203 |
| 5,562,316 | 10/1996 | Bullock et al. | 292/DIG. 32 |

FOREIGN PATENT DOCUMENTS

| | | | |
|---|---|---|---|
| 960720 | 1/1975 | Canada | 292/DIG. 32 |
| 2443946 | 8/1980 | France | 70/203 |
| 93/14956 | 8/1993 | WIPO | 70/211 |

*Primary Examiner*—Rodney M. Lindsey
*Attorney, Agent, or Firm*—Wenderoth, Lind & Ponack

[57] ABSTRACT

A locking device prevents a rod for closing a door of a container or truck from being rotated in an unlocking direction so as to keep the container doors locked, even if a control handle of the rod should be cut. The rod has is provided near the surface of the door so as to be rotatable about its axis into and out of engagement with door closing members fixed on the container body. The locking device has a first locking member mounted on the control handle at a base portion thereof, a second locking member mounted at a position opposite to the first locking member across the control handle, and a fixing member for inseparably fixing the second locking member to the first locking member. The second locking member prevents the rotation of the rod in the unlocking direction by abutting the surface of the door when the second locking member and the first locking member are inseparably coupled together around the control handle.

16 Claims, 9 Drawing Sheets

LOCKING DEVICE FOR CONTAINER DOOR

This application is a continuation of now abandoned, application, Ser. No. 08/630,504, filed Apr. 10, 1996, now abandoned.

BACKGROUND OF THE INVENTION

This invention relates to a locking device for locking a container or truck door by preventing a door closing rod that engages with door closing members secured to the container body from rotating about its axis.

FIG. 8 shows a container to be transported on a freight train or the like. It has cargo loading/unloading doors 23 at its front. The doors 23 are mounted at their outer edges to a container body 24 by means of hinges 25 so as to be pivotable outward about the hinges 25.

A plurality of rods 2 extend vertically at the front of the doors 23 to keep the doors closed. They have both their ends coupled to the container body 24 so as to be rotatable about their axes.

Referring to FIG. 9, each rod 2 has a pair of vertically arranged, outwardly extending jaws 26 at either end thereof. A door closing member 27 is provided on the container body 24 near each jaw 26.

As shown in FIG. 9D, the jaws 26 and the door closing members 27 can be engaged and disengaged by rotating the rod 2. When they are engaged, the doors 23 of the container or truck 22 cannot be opened. Namely, the doors 23 are locked in a closed state.

As shown in FIGS. 8 and 10, the door closing rod 2 has a handle 3. The rod 2 can be turned by moving the handle 3. By turning the handle 3 inward to the position close to the surface of the door 23 of the container 22, the jaws 26 of the rod 2 will engage the door closing member 27 fixed to the container body 24, thus locking the door 23. By turning the handle 3 outward from this position, the rod 2 is turned in the direction shown by the arrow in FIG. 9D until the jaws 26 disengage from the door closing members 27. Now the door 23 can be opened outward.

During transportation, in order to prevent theft of the contents of such a container or truck 22, the handle 3 of each door closing rod 2 is fitted in a lever holding/locking member 32 fixed to the surface of the door 23 and locked in position by means of a locking pin or a lever tumbler lock 33 as shown in FIG. 10. Once locked in position, the handle 3 of the rod 2 cannot be turned outward, so that the door 23 cannot be opened.

But since the handle 3 of the rod 2 is simply locked in position by securing it to the surface of the door 23, an unauthorized person can unlock and open the door 23 relatively easily by, e.g., cutting the holding/locking member 32 with a fret saw and turning the rod 2. Thus, the contents of such conventionaly locked containers or trucks are frequently stolen.

SUMMARY OF THE INVENTION

An object of this invention is to provide a locking device which can keep the door closing rod in an unrotatable position and thus keep the container or truck doors locked even if the handle of the rod or the holding/locking member should be cut.

According to this invention, there is provided a locking device for a rod for keeping a door of a container or truck closed, the rod having a control handle and being provided near the surface of the door so as to be rotatable about its axis into and out of engagement with door closing members fixed on the container or truck body. The locking device comprises a first locking member mounted on the control handle at the root portion thereof, a second locking member mounted at a position opposite to the first locking member across the control handle, and a fixing member for unseparably fixing the second locking member to the first locking member, thereby preventing rotation of the rod in an unlocking direction.

Since the second locking member can be unseparably coupled to the first locking member around the control handle by means of the fixing member, they are kept fixed to the rod even if the control handle of the rod should be cut. Thus, the second locking member can prevent rotation of the rod in the unlocking direction by abutting the surface of the container or truck door, thereby keeping the container or truck locked.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
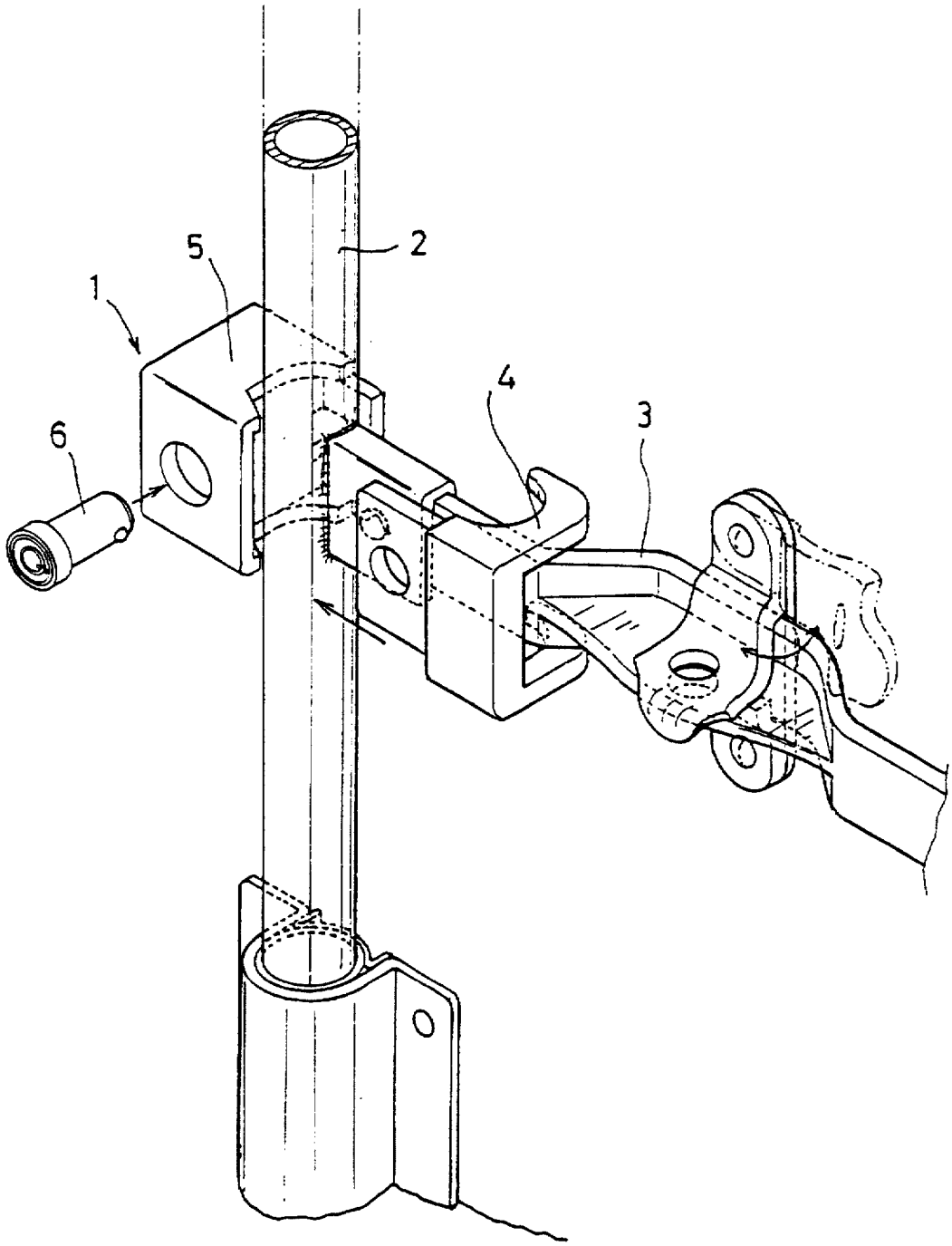
FIG. 1 is a perspective view of a locking device according to this invention showing how the device is actually mounted.

Now referring to the drawings, description is made of an embodiment of a locking device 1 for locking a rod for closing container or truck doors.

The locking device 1 shown in FIG. 1 comprises a first locking member 4 fitted on a handle 3 of a door closing rod 2 near its root, and a second locking member 5 provided across the rod 2 opposite to the first locking member 4 and engaging the first member 4. A pin 6 inseparably fixed the second locking member 5 to the first locking member 4.

Figure 2A:
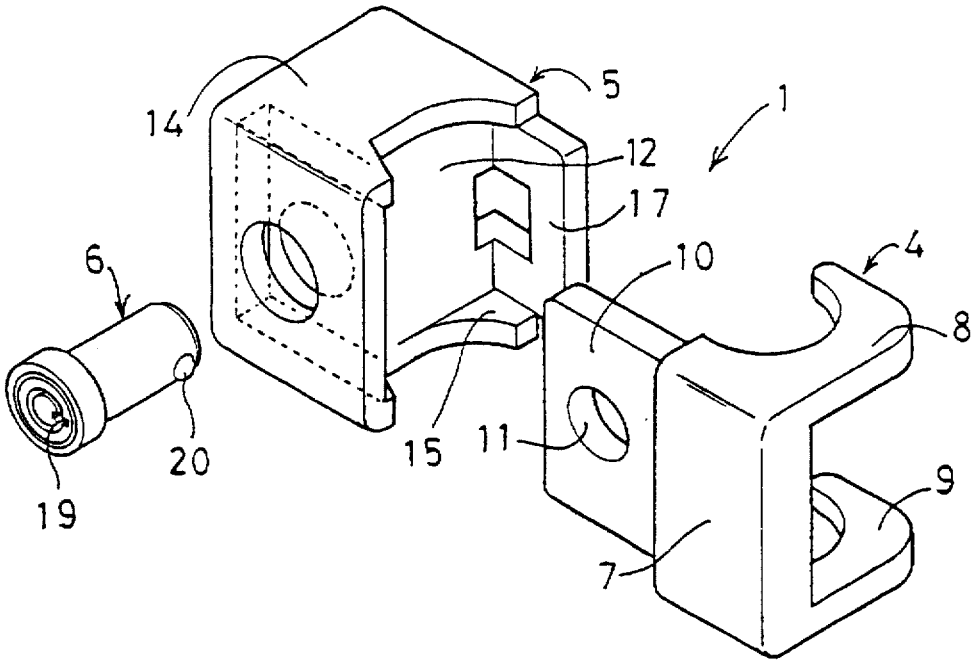
FIGS. 2A and 2B are exploded perspective views of the locking device of FIG. 1.
Figure 2B:
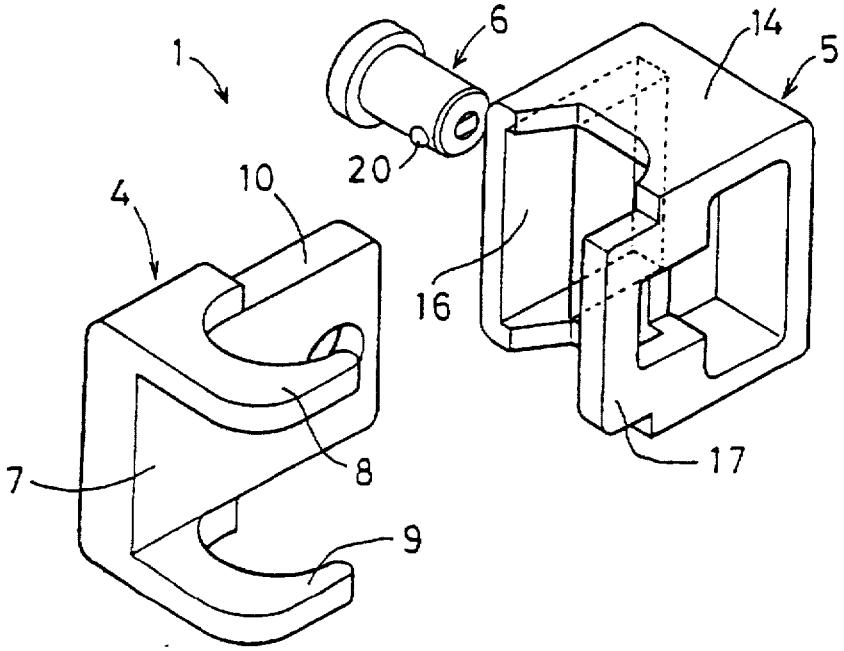

Referring to FIG. 2, the first locking member 4 is a U-shaped member comprising a front wall 7, a top wall 8 and a bottom wall 9. The top wall 8 and the bottom wall 9 have their lefthand edges cut out arcuately to surround and grip the rod and to prevent the locking assembly from sliding up or down along the axis of the rod, away from the base of the handle 3.

The first locking member 4 also has a coupling wall 10 integral with the front wall 7 and protruding leftwardly from the front wall. Its vertical width is smaller than that of the front wall 7.

The coupling wall 10 has a hole 11 for receiving the pin 6 near its center.

Figure 3A:
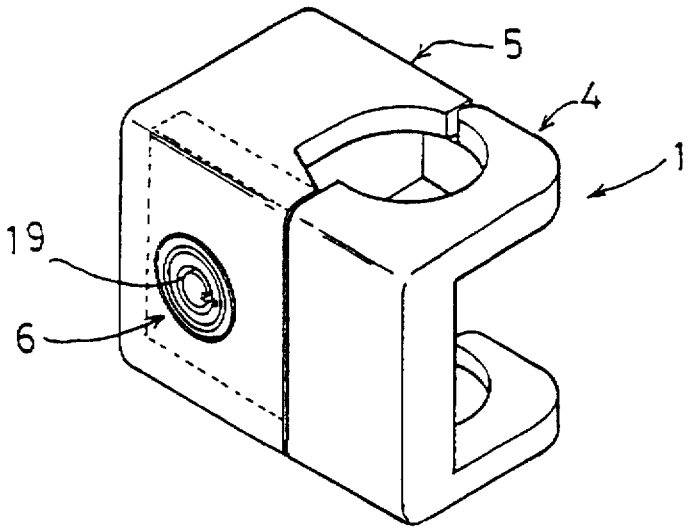
FIGS. 3A and 3B are perspective views of the locking device of FIG. 2 in its locked state.
Figure 4:
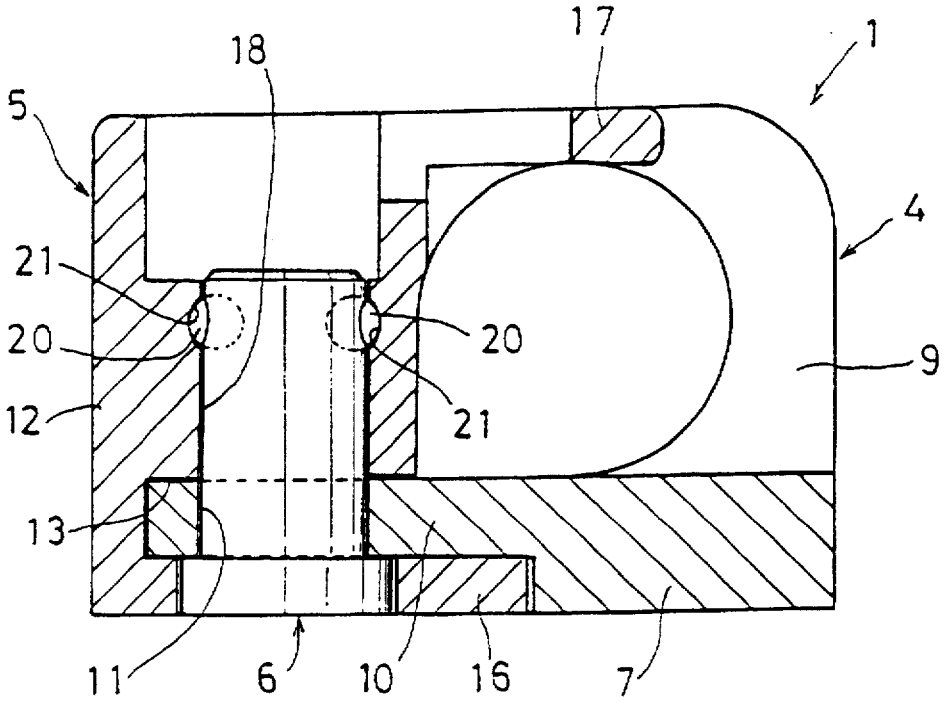
FIG. 4 is a sectional view of the locking device of FIG. 3.

As shown in FIG. 2, the second locking member 5 is a box-shaped member having an opening on its righthand side. The coupling wall 10 of the first locking member 4 can be inserted into the second locking member 5 from its righthand side as shown in FIG. 3A. As shown in FIG. 4, the left side wall 12 of the second locking member 5 has, on its inner surface, a groove 13 in which the lefthand end of the coupling wall 10 is received when it is inserted into the second locking member 5.

Figure 3B:
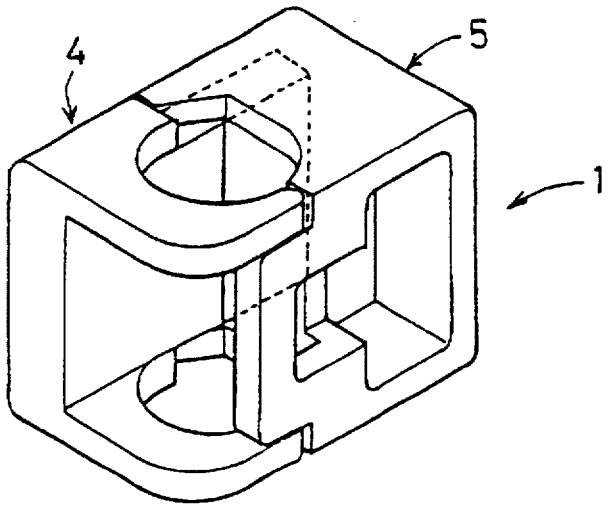

The top wall 14 and the bottom wall 15 of the second locking member 5 have their righthand edges cut out. The member 5 is formed with a through hole 18 having one end open to the front wall 16 and the other end open to the rear wall 17 to receive the pin 6. At its end open to the front wall 16, the hole 18 has a large diameter to receive the head of the pin 6. The rear wall 17 has a portion protruding rightwardly. As shown in FIG. 3B, this portion snugly fits between the top wall 8 and the bottom wall 9 of the first locking member 4 with the coupling wall 10 inserted in the groove 13.

Thus, as shown in FIG. 3, the first locking member 4 and the second locking member 5 are coupled together. As shown in FIG. 4 the coupling wall 10 of the first locking member 4 is fitted into the groove 13 of the second locking member 5, and the rear wall 17 of the second locking member 5 is fitted between the top wall 8 and the bottom wall 9 (FIG. 2) of the first locking member 4. In this state, the respective holes 11 and 18 (FIG. 4) of the first locking member 4 and the second locking member 5 align with each other.

The first locking member 4 and the second locking member 5 are made of a hard metal so that they may not be easily deformed by external forces. They may be formed by die-casting, forging or by welding metal plates together.

Referring to FIGS. 3 and 4, the pin 6 is inserted through the respective holes 11 and 18 of the first locking member 4 and the second locking member 5 to inseparably couple the first coupling member 4 and the second locking member 5.

The pin 6 has a locking function. That is, by turning a key inserted in a key hole 19 (FIG. 2A) formed in the top of the head of the pin 6, metal balls or pins 20 housed in the tip of the pin 6 are adapted to come out (FIG. 4).

By protruding the metal balls or pins 20 from the outer periphery of the pin 6, with the pin 6 completely inserted into the holes 11 and 18 of the first locking member 4 and the second locking member 5, the balls or pins 20 will move into engagement with grooves 21 formed on the inner periphery of the hole 18 of the second locking member 5. In this state, the pin 6 cannot be pulled out of the holes 11 and 18 of the first locking member 4 and the second locking member 5. To pull it out of the holes 11 and 18, the metal balls or pins 20 have to be disengaged from the grooves 21 by retracting them into the pin 6.

The locking device for a rod 2 for closing container doors is used as follows.

First, as shown in FIG. 1, with the control handle 3 of the door closing rod 2 positioned between the top wall 8 and the bottom wall 9 of the first locking member 4, the first locking member 4 is mounted on the base of the control handle 3.

Then, the second locking member 5 is positioned across the door closing rod 2 from the first locking member 4 to couple it to the first locking member 4.

In this state, the pin 6 is inserted into the holes 11 and 18 of the first locking member 4 and the second locking member 5 to inseparably join the first locking member 4 and the second locking member 5 together.

Figure 5:
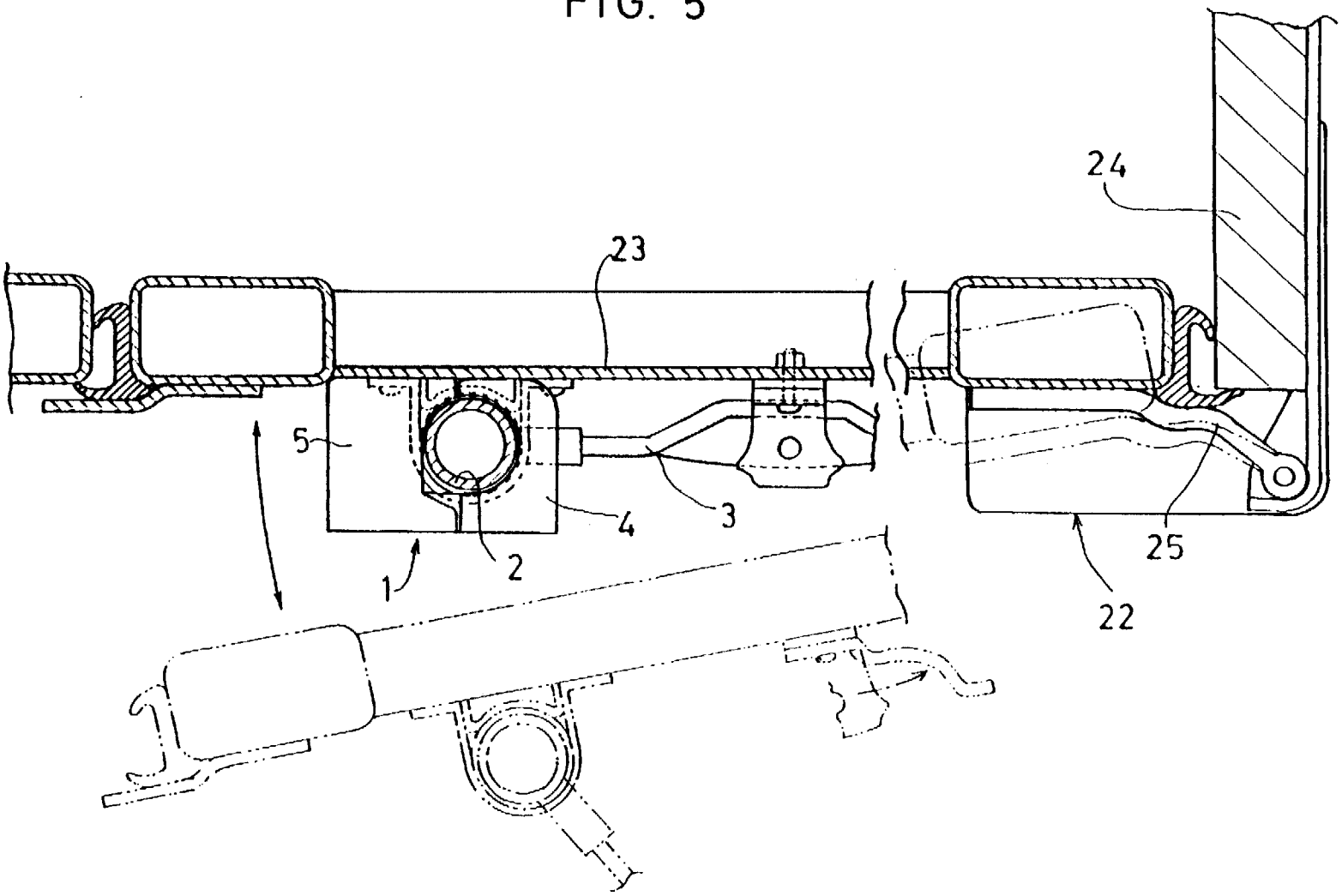
FIG. 5 is a sectional view of the locking device of FIG. 1 showing its operation.

The door closing rod 2 is now surrounded over the entire circumference thereof by the first locking member 4 and the second locking member 5 as shown in FIG. 5. Also, it is located very close to the surface of the door 23 of the container 22.

Thus, if attempts are made to turn the control handle 3 outward, the rear surface of the second locking member 5 will abut the surface of the door 23, so that the door closing rod 2 will never rotate. The jaws 26 will never disengage from the respective door closing members 27, keeping the container or truck 22 locked.

Since the control handle 3 is completely surrounded at its root by the locking device 1, it is practically impossible to cut the control handle 3 at its root portion.

Even if the control handle 3 should be cut at a portion other than its root portion, it is impossible to rotate the door closing rod 2 because the locking device 1 is still coupled to the rod 2, so that the door of the container or truck 22 can be kept locked. The locking device can thus prevent theft with a high reliability.

To unlock the container or truck 22, the pin 6 is pulled out of the holes 11 and 18 of the first locking member 4 and the second locking member 5 after retracting the metal balls or pins 20 into the pin 6. The first locking member 4 and the second locking member 5 are then pulled away from each other until they disengage from the door closing rod 2. Now the rod 2 is rotatable, so that the door 23 can be opened as shown by chain line in FIG. 5.

As shown in FIG. 5, the doors 23 of a container or truck overlap each other along their opposite edges. Thus, by coupling only one locking device to the rod closing one of the doors overlapping the other from outside, it is possible to lock both doors.

Figure 6:
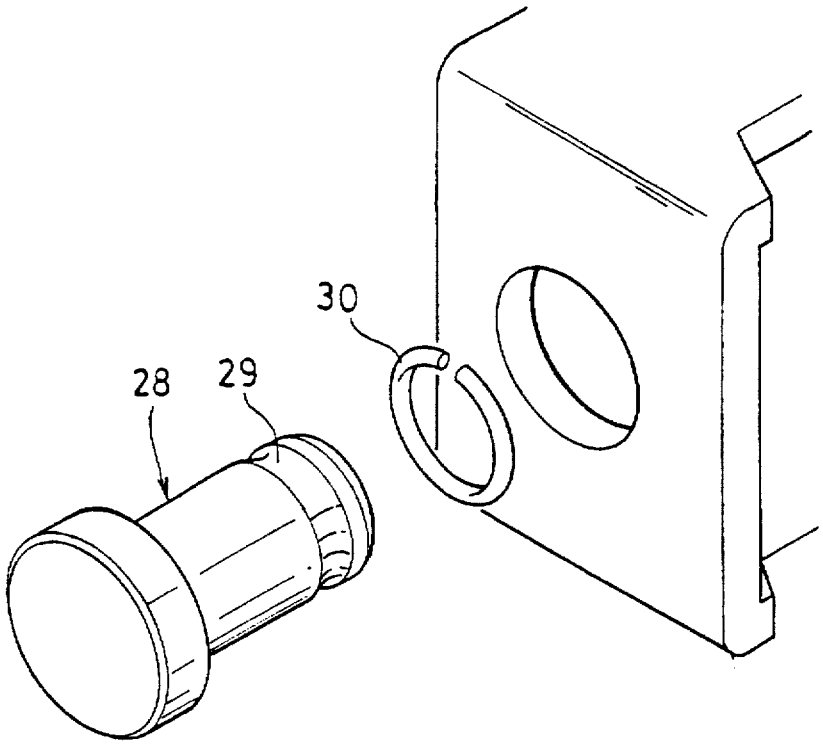
FIG. 6 is a perspective view of another embodiment of a locking device of this invention.
Figure 7:
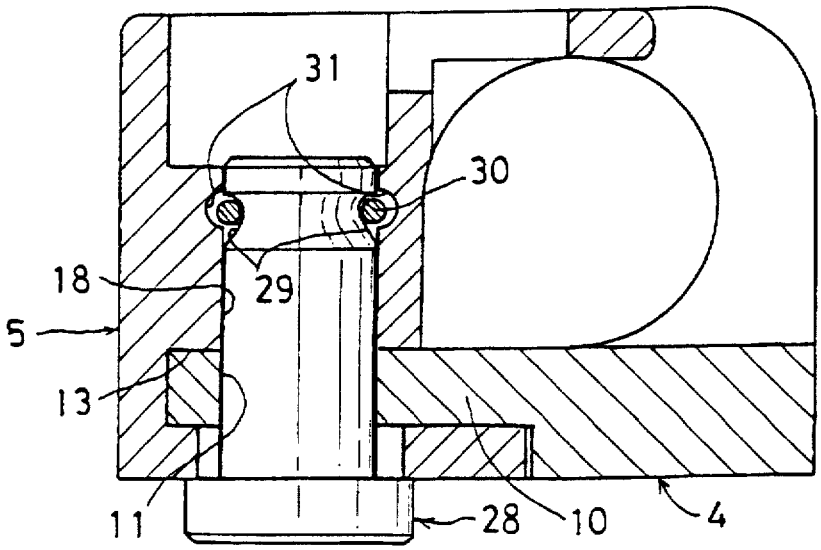
FIG. 7 is a sectional view of the locking device of FIG. 6.
Figure 8:
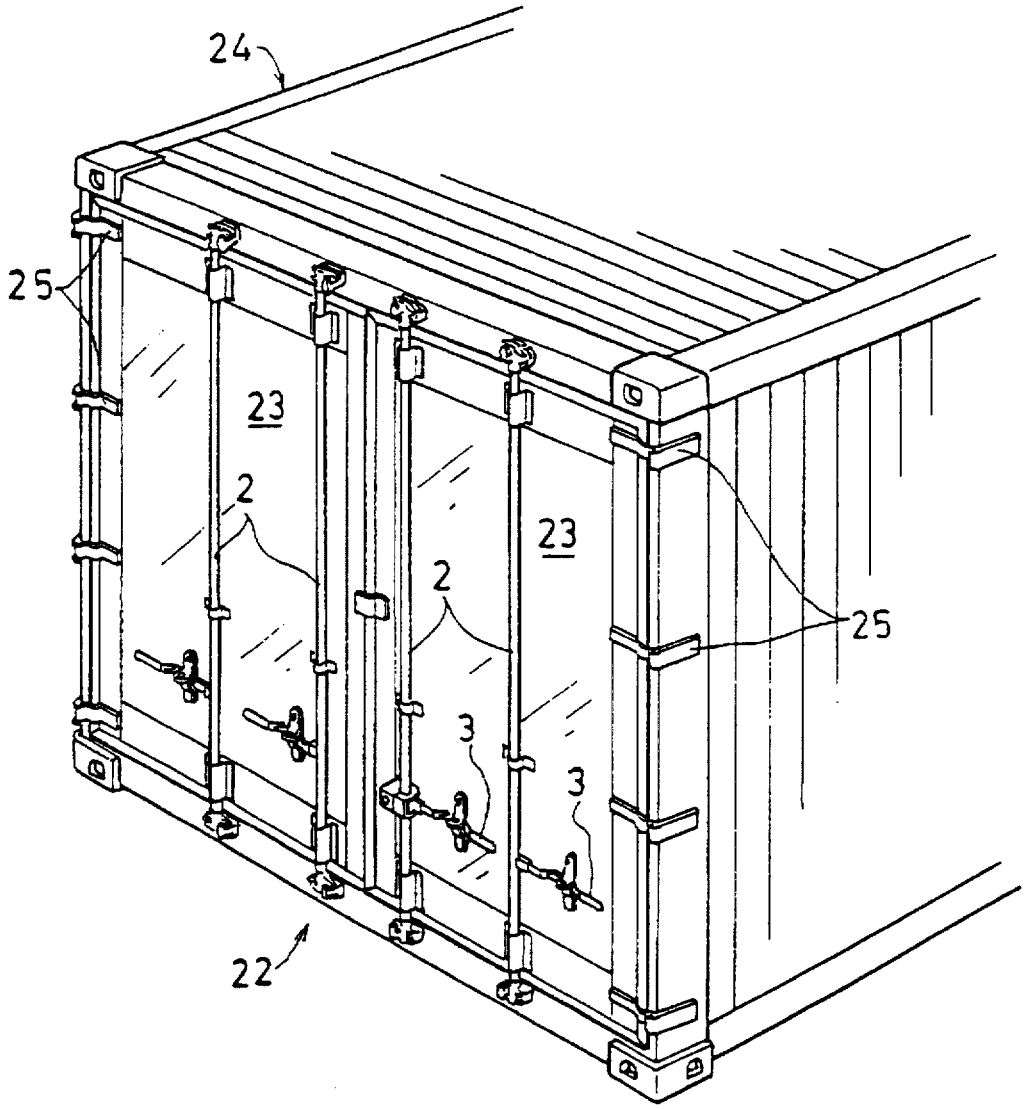
FIG. 8 is a perspective view of a container.
Figure 9A:
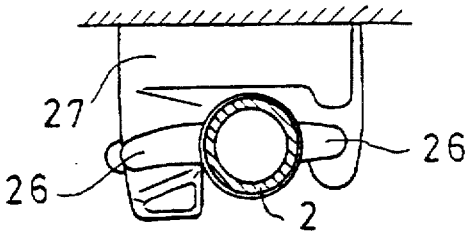
FIGS. 9A to 9D show how jaws of a rod and door closing members are engaged and disengaged.
Figure 9B:
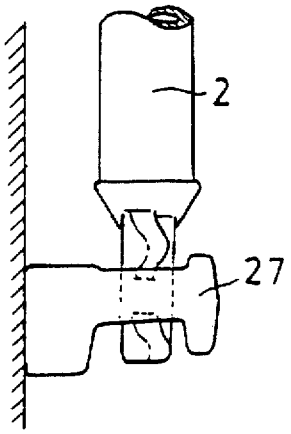
Figure 9C:
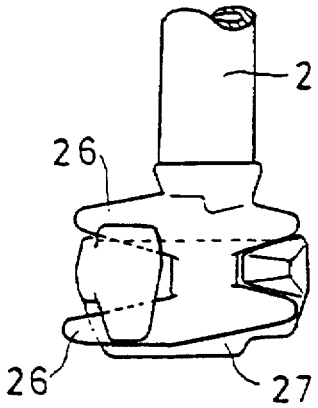
Figure 9D:
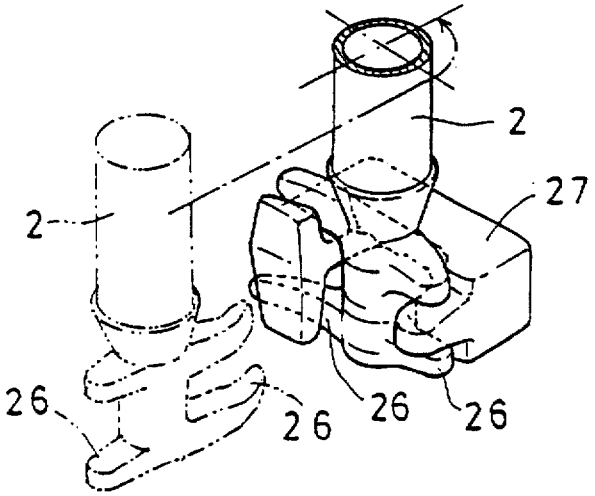
Figure 10:
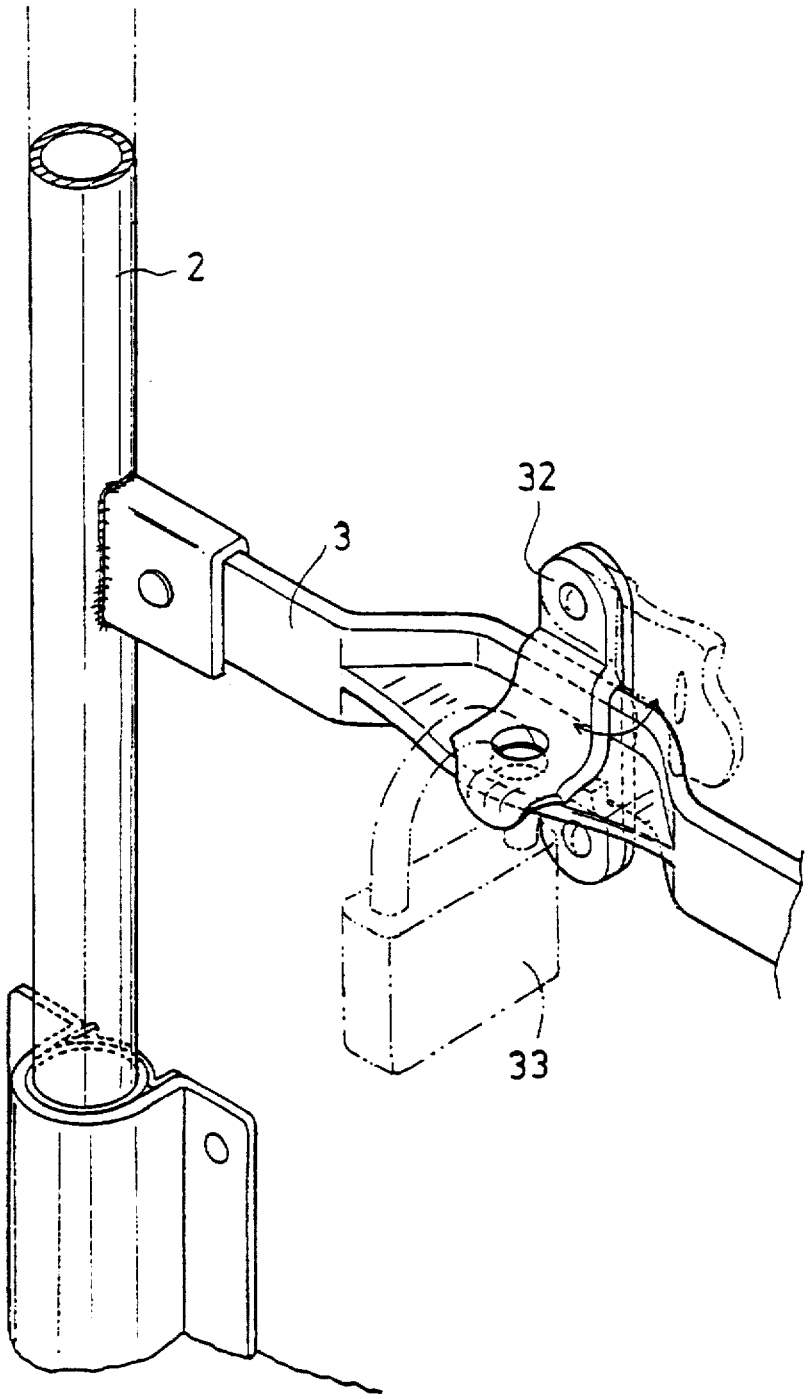
FIG. 10 PRIOR ART
FIG. 10 is a perspective view of a conventional locking device.

FIGS. 6 and 7 show another type of fixing pin 28.

This pin 28 has no locking/unlocking function as with the pin 6. It carries an annular spring ring 30 received in a groove 29 formed on its outer periphery near the tip.

As shown in FIG. 7, the annular spring 30 is received in both the groove 29 formed in the pin 28 and an annular groove 31 formed in the inner periphery of the hole 18.

As shown in FIG. 7, the groove 29 formed in the pin 28 has its side near the tip of the pin 28 rising steeply and its side near the head of the pin 28 rising rather moderately. Thus, if trials are made to pull the pin 28 out of the holes 11 and 18, the annular spring 30 will be caught by the edge of the groove 29 near the tip of the pin 28 and the edge of the groove 31 near the head of the pin 28, so that the pin 28 can never be pulled out of the holes 11 and 18.

In order to disengage the locking device 1 from the door closing rod 2, the head of the pin has to be removed by grinding it down with e.g. a grinder. Then, by striking the front end of the now headless pin 28 with, e.g., a small-diameter hammer, the pin 28 can be moved inward, because the annular spring 30 slides along the moderately sloping inner wall of the groove 29.

When the tip of the pin 28 reaches the rear end face of the second locking member 5, the entire pin 28 is completely clear of the coupling wall 10. Now it is possible to disengage the locking device 1 from the door closing rod 2 by pulling the coupling wall 10 out of the groove 13 and then separating the first locking member 4 from the second locking member 5.

In this embodiment, the rear end of the second locking member 5 is positioned close to the surface of the door 23, but may be positioned in contact with or spaced rather apart from the surface of the door 23, provided the locking device 1 can prevent the door closing rod 2 from being rotated to such an extent that the jaws 26 of the rod 2 disengage from the door closing members 27.

According to this invention, even if the control handle should be cut, the container or truck doors can be kept locked. Thus, it is possible to prevent theft of the contents of the container with extremely high reliability.

What is claimed is:

1. A door assembly and a locking device for said door assembly, said door assembly including a door having a pivotal door closing rod extending along a surface of said door and a control handle fixed to said door closing rod for pivoting said rod, said control handle having a base portion connected to said rod, said locking device comprising:

a first locking member comprising a first front wall confronting and contacting said base portion of said control handle, a pair of first horizontal walls extending substantially perpendicularly from said first front wall and receiving and contacting said rod, and a substantially flat coupling wall extending from said first front wall substantially parallel to said first front wall;

a second locking member engaged with said first locking member and positioned opposite to said first locking member with respect to said rod, said second locking member being a separate member from said first locking member and comprising a substantially flat second front wall, a rear wall extending substantially parallel to said second front wall and having a rigid substantially flat contact surface, and a pair of second horizontal walls connected to and extending substantially perpendicular to said second front wall and said rear wall;

said coupling wall being received in said second locking member parallel to said second front wall, with said rod held by said first and second horizontal walls, said control handle being held by said first front wall, and said rigid flat contact surface being juxtaposed with said door for contact therewith; and a fixing member inseparably fixing said coupling wall with said second front wall together with said coupling wall juxtaposed with said second front wall.

2. The locking device of claim 1, wherein said coupling wall and said second front wall comprise respective holes and said fixing member is a pin that is inserted into said holes, said pin comprising means for preventing removal of said pin from said holes once said pin has been inserted into said holes.

3. The locking device of claim 2, wherein said means for preventing removal comprises a key hole in said pin and members that are laterally movable into and out of said pin for engagement with one of said first and second locking members in response to the turning of a key in said key hole.

4. The locking device of claim 2, wherein said means for preventing removal of said pin comprises an annular groove formed in one of said holes, a second groove formed on the outer periphery of said pin and an annular spring ring disposed in said second groove for engagement with said annular groove formed in one of said holes.

5. The locking device of claim 1, wherein said pair of first horizontal walls of said first locking member comprise curved surfaces receiving said rod.

6. The locking device of claim 5, wherein said pair of first horizontal walls are spaced apart so as to receive said base portion of said control handle therebetween.

7. The locking device of claim 1, wherein said coupling wall is a rigid member having a locking aperture therein and said second locking member comprises a slot having a shape corresponding to said rigid member juxtaposed with said second front wall, said second front wall having a corresponding aperture therein aligned with said locking aperture and receiving said fixing member.

8. The locking device of claim 7, wherein said slot is partially defined by an intermediate portion having a second corresponding aperture therein aligned with the first said corresponding aperture.

9. A locking device for a door assembly including a door having a pivotal door closing rod extending along a surface of the door and a control handle fixed to the door closing rod for pivoting the rod, the control handle having a base portion connected to the rod, said locking device comprising:

a first locking member comprising a first front wall adapted to confront and contact the base portion of the control handle, a pair of first horizontal walls extending substantially perpendicularly from said first front wall and adapted to receive and contact the rod, and a substantially flat coupling wall extending from said first front wall substantially parallel to said first front wall;

a second locking member adapted to be engaged with said first locking member and positioned opposite to said first locking member with respect to said rod, said second locking member being a separate member from said first locking member and comprising a substantially flat second front wall, a rear wall extending substantially parallel to said second front wall and having a rigid substantially flat contact surface, and a pair of second horizontal walls connected to and extending substantially perpendicular to said second front wall and said rear wall;

said coupling wall being configured to be received in said second locking member parallel to said second front wall so that the rod can be held by said first and second horizontal walls, the control handle can be held by said first front wall, and said rigid flat contact surface can be juxtaposed with the door for contact therewith; and a fixing member adapted to fix said coupling wall with said second front wall together when said coupling wall is juxtaposed with said second front wall.

10. The locking device of claim 9, wherein said coupling wall and said second front wall comprise respective holes and said fixing member is a pin that is insertable into said holes, said pin comprising means for preventing removal of said pin from said holes once said pin has been inserted into said holes.

11. The locking device of claim 10, wherein said means for preventing removal comprises a key hole in said pin and members that are laterally movable into and out of said pin for engagement with one of said first and second locking members in response to the turning of a key in said key hole.

12. The locking device of claim 10, wherein said means for preventing removal of said pin comprises an annular groove formed in one of said holes, a second groove formed on the outer periphery of said pin and an annular spring ring disposed in said second groove for engagement with said annular groove formed in one of said holes.

13. The locking device of claim 9, wherein said pair of first horizontal walls of said first locking member comprise curved surfaces adapted to receive the rod.

14. The locking device of claim 13, wherein said pair of first horizontal walls are spaced apart so as to be capable of receiving the base portion of the control handle therebetween.

15. The locking device of claim 9, wherein said coupling wall is a rigid member having a locking aperture therein and said second locking member comprises a slot having a shape corresponding to said rigid member juxtaposed with said second front wall, said second front wall having a corresponding aperture therein for alignment with said locking aperture for receiving said fixing member.

16. The locking device of claim 15, wherein said slot is partially defined by an intermediate portion having a second corresponding aperture therein aligned with the first said corresponding aperture.

* * * * *